US006449819B2

(12) United States Patent
Tanaka et al.

(10) Patent No.: US 6,449,819 B2
(45) Date of Patent: Sep. 17, 2002

(54) ELECTRONICALLY CONTROLLED SAMPLE WARPER, ROTARY CREEL ASSEMBLY, AND WARPING METHOD

(75) Inventors: Yoshihiro Tanaka; Takatsugu Aihara, both of Kiryu (JP)

(73) Assignee: Suzuki Warper Ltd., Gunma-ken (JP)

( * ) Notice: Subject to any disclaimer, the term of this patent is extended or adjusted under 35 U.S.C. 154(b) by 0 days.

(21) Appl. No.: 09/796,539

(22) Filed: Mar. 2, 2001

(30) Foreign Application Priority Data

Mar. 17, 2000 (JP) ..... 2000-076720

(51) Int. Cl.[7] ..... D02H 3/00
(52) U.S. Cl. ..... 28/190
(58) Field of Search ..... 28/190, 192, 194, 28/193, 191

(56) References Cited

U.S. PATENT DOCUMENTS 4,538,776 A * 9/1985 Perry ..... 242/131
4,972,562 A 11/1990 Tanaka et al.
5,630,262 A * 5/1997 Tanaka ..... 28/184
5,950,289 A * 9/1999 Tanaka ..... 28/184
5,970,591 A 10/1999 Tanaka et al.
6,173,480 B1 * 1/2001 Tanaka ..... 28/190

FOREIGN PATENT DOCUMENTS

| | | |
|---|---|---|
| DE | 198 45 245 C1 | 9/1999 |
| EP | 0 375 480 A2 | 6/1990 |
| EP | 0 933 455 A2 | 8/1999 |
| JP | 62-62942 | 3/1987 |

* cited by examiner

*Primary Examiner*—Danny Worrell
(74) *Attorney, Agent, or Firm*—Arent Fox Kintner Plotkin & Kahn

(57) ABSTRACT

An electronically controlled sample warper having a yarn exchanging mechanism is provided which comprises a rotary creel supporting a plurality of bobbins around which different kinds and/or the same kind of yarns are wound and a bobbin station supporting a plurality of bobbins on which different kinds and/or the same kind of yarns are wound in a standby state. With this construction, it is possible to employ various kinds of yarns and perform yarn exchanging thereof unlimitedly, thus enabling various pattern warping to be freely performed with the reduced warping time.

4 Claims, 4 Drawing Sheets

ELECTRONICALLY CONTROLLED SAMPLE WARPER, ROTARY CREEL ASSEMBLY, AND WARPING METHOD

BACKGROUND OF THE INVENTION

1. Field of the Invention

The present invention relates to a novel electronically controlled sample warper, wherein a rotary creel supporting detachably a plurality of bobbins around which different kinds and/or the same kind of yarns are wound and a bobbin station supporting detachably a plurality of bobbins in a standby state are used, and various kinds of yarns are exchanged according to the preset pattern data (yarn order), so that more kinds of yarns than the conventional ones can be wound on a warper drum, a rotary creel assembly used in the electronically controlled sample warper, and a novel warping method using the rotary creel assembly.

2. Description of the Related Art

As an electronically controlled sample warper which has been used conventionally, there is known a structure as disclosed, for example, in Japanese Patent No. 1529104, where using a fixed creel supporting a plurality of bobbins around which different kinds (different colors or different twists) and/or the same kind of yarns are wound, the yarns are wound on a warper drum with a yarn introduction means while the yarn exchanging is performed by yarn selection guides according to the preset pattern data (yarn order).

Also, there has been known an electronically controlled sample warper which can warp a plurality of yarns concurrently, wherein time loss required for the yarn exchanging is cancelled and a plurality of yarns can concurrently be wound on a warper drum by using a rotary creel as well as omitting the yarn exchanging step, and further a period of time required for the warping work can be reduced (see Japanese Patent No. 1767706, U.S. Pat. No. 4, 972,662, and EP No. 0375480).

Since the fixed creel has a plurality of bobbins around which different kinds and/or the same kind of yarns (mainly different kinds of yarns) are wound and it is used for warping the yarns one by one, it is advantageously possible to perform pattern warping, but the yarns are wound on a warper drum one by one, so it takes disadvantageously much time to perform warping work correspondingly. Meanwhile, the rotary creel has a plurality of bobbins around which the same kind and/or different kinds of yarns are wound, and it is used for the plain warping (for example, only red color yarns), and the limited pattern warping, such as one to one warping (for example, repetition of a yarn of red color and a yarn of white color, or repetition of a yarn of S twist and a yarn of Z twist), two to two warping (for example, repetition of two yarns of red color and two yarns of white color, or repetition of two yarns of S twist and two yarns of Z twist). With the rotary creel, it is disadvantageously impossible to perform pattern warping other than the limited pattern warping, but it is advantageously possible to wind a plurality of yarns concurrently on the warper drum so that the warping time is reduced largely.

SUMMARY OF THE INVENTION

With the foregoing drawbacks of the prior art in view, it is an object of the present invention to provide an electronically controlled sample warper, a rotary creel assembly, and a warping method wherein, using a rotary creel, it is possible to freely perform the yarn exchanging of various yarns, thereby various pattern warping and reduction of the warping time being realized.

To attain the foregoing object, the first aspect of an electronically controlled sample warper of the present invention comprises: a warper drum; a plurality of yarn introduction means each mounted to a side surface of the warper drum for winding a yarn on the warper drum; a plurality of yarn selection guides arranged in one end portion of a base for supporting the warper drum in correspondence to the yarn introduction means, each the yarn selection guide being pivotally moved to protrude to a yarn exchanging position when a yarn is exchanged and pivotally moved to retract to a standby position when a yarn is stored; a rotary creel supporting a plurality of bobbins around which different kinds and/or the same kind of yarns are wound, the rotary creel being positioned adjacent corresponding ones of the plurality of yarn selection guides; and a bobbin station supporting a plurality of bobbins around which different kinds and/or the same kind of yarns are wound in a standby state, wherein yarns are passed between the yarn introduction means and the yarn selection guides as well as the bobbins are passed between the rotary creel and the bobbin station such that the bobbin for a yarn held by the yarn introduction means and wound on the warper drum is supported on the rotary creel while the bobbin for a yarn stored in the yarn selection guide is supported by the bobbin station in a standby state, so that the yarns are exchanged according to the preset yarn order to be wound on the warper drum.

The second aspect of an electronically controlled sample warper of the present invention comprises: a warper drum; a plurality of yarn introduction means each mounted to a side surface of the warper drum for winding a yarn on the warper drum; a plurality of yarn selection guides arranged in one end portion of a base for supporting the warper drum in correspondence to the yarn introduction means, each the yarn selection guide being pivotally moved to protrude to a yarn exchanging position when a yarn is exchanged and pivotally moved to retract to a standby position when a yarn is stored; and a rotary creel supporting a plurality of bobbins around which different kinds and/or the same kind of yarns are wound, the rotary creel being positioned adjacent corresponding ones of the plurality of yarn selection guides, wherein yarns are passed between the yarn introduction means and the yarn selection guides, so that the yarns are exchanged according to the preset yarn order to be wound on the warper drum.

A rotary creel assembly of the present invention comprises: a rotary creel supporting a plurality of bobbins around which different kinds and/or the same kind of yarns are wound, the rotary creel being positioned adjacent corresponding ones of the plurality of yarn selection guides; and a bobbin station supporting a plurality of bobbins around which different kinds and/or the same kind of yarns are wound in a standby state.

A warping method of the present invention, using an electronically controlled sample warper having: a warper drum; a plurality of yarn introduction means each mounted to a side surface of a warper drum for winding a yarn on the warper drum; a rotary creel supporting a plurality of bobbins around which different kinds and/or the same kind of yarns are wound, the rotary creel being positioned adjacent corresponding ones of the plurality of yarn selection guides; and a bobbin station supporting a plurality of bobbins around which different kinds and/or the same kind of yarns are wound in a standby state, wherein the bobbins are passed between the rotary creel and the bobbin station such that the bobbin for a yarn held by the yarn introduction means and wound on the warper drum is supported by the rotary creel while the bobbin for a yarn stored in the yarn selection guide is supported by the bobbin station in a standby state, so that the yarns are exchanged according to the preset yarn order to be wound on the warper drum.

DETAILED DESCRIPTION OF THE PREFERRED EMBODIMENT

The present invention will hereinafter be described in connection with embodiments with reference to the accompanying drawings.

Figure 1:
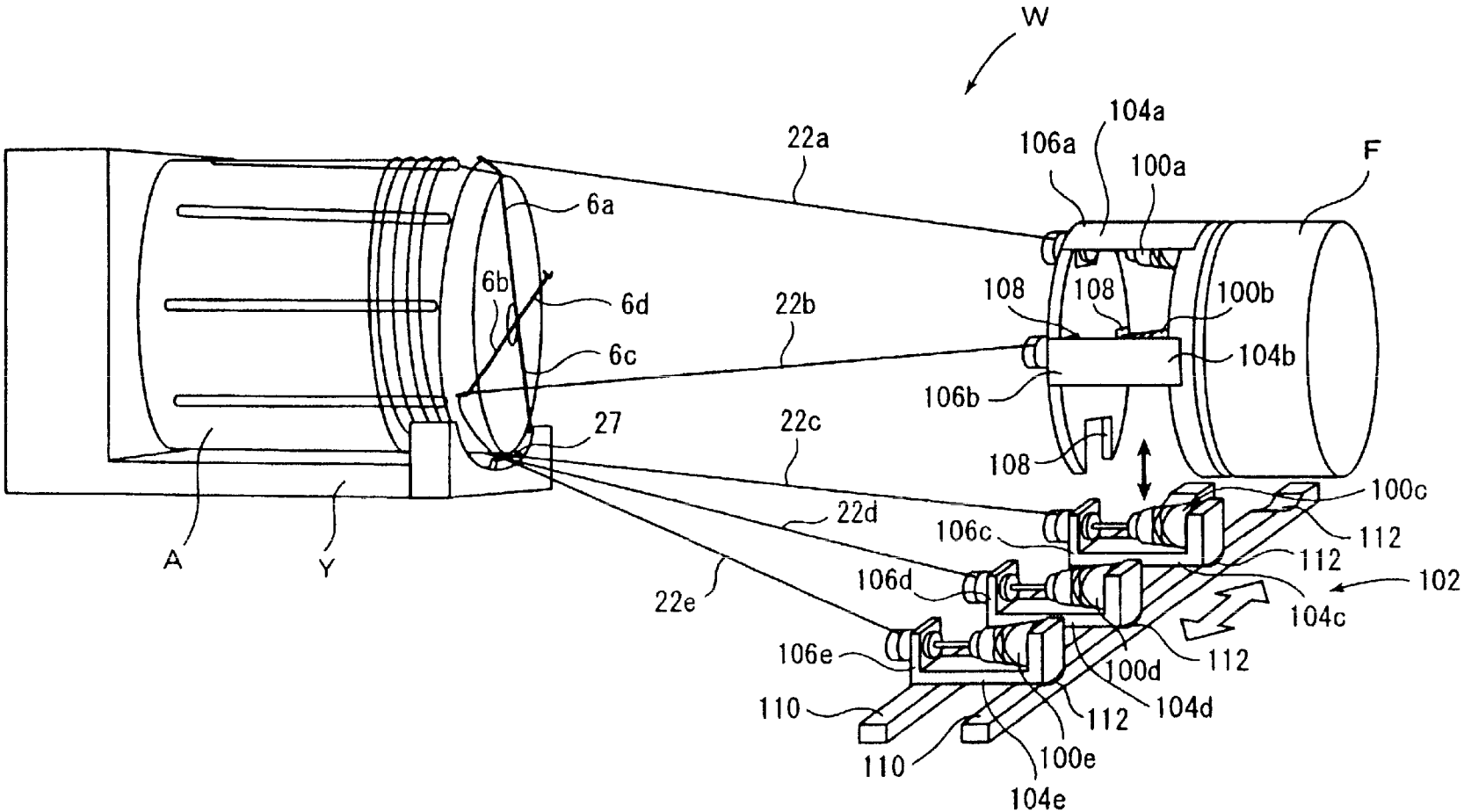
FIG. 1 is an entire explanatory view schematically showing an embodiment of an electronically controlled sample warper according to the present invention.

In FIG. 1, an electronically controlled sample warper W of the present invention comprises: a warper drum A; a plurality of yarn introduction means 6*a* to 6*d* (four in the illustrated embodiment) each mounted to a side surface of the warper drum for winding yarns 22*a* to 22*e* on the warper drum A; and a plurality of yarn selection guides 27 arranged in one end portion of a base for supporting the warper drum A in correspondence to the yarn introduction means 6*a* to 6*d*, each the yarn selection guide 27 being pivotally moved to protrude to a yarn exchanging position when the yarns 22*a* to 22*e* are exchanged and pivotally moved to retract to a standby position when the yarns 22*a* to 22*e* are stored, wherein yarns 22*a* to 22*e* are passed between the yarn introduction means 6*a* to 6*d* and the yarn selection guides 27, so that the yarns 22*a* to 22*e* are exchanged according to the preset yarn order to be wound on the warper drum A. The basic structure and operation of the electronically controlled sample warper W are well-known from the above-mentioned patent publications, and detailed description thereof will be omitted.

In the electronically controlled sample warper W of the present invention, there are positioned adjacent corresponding ones of the plurality of yarn selection guides 27 a rotary creel F supporting a plurality of bobbins 100*a* to 100*e* (five in the illustrated embodiment) around which different kinds and/or the same kind of yarns 22*a* to 22*e* are wound, and a bobbin station 102 supporting a plurality of bobbins 100*a* to 100*e* around which different kinds and/or the same kind of yarns are wound in a standby state.

The characteristic structure of the present invention resides in that the bobbins 100*a* to 100*e* can detachably be supported by the rotary creel F and the bobbin station 102, respectively, and the bobbins 100*a* to 100*e* can be passed freely between the rotary creel F and the bobbin station 102.

In FIG. 1, reference numerals 104*a* to 104*e* denote bobbin bodies, which are composed of bobbin frames 106*a* to 106*e* and the bobbins 100*a* to 100*e* attachable thereto, thereby the attaching and detaching operation of the bobbins 100*a* to 100*e* being easy. The basic structure of the rotary creel F is not changed from a conventional one. However, the rotary creel F is provided at its front portion with a plurality of bobbin receiving recesses 108 (four in the illustrated embodiment), into which the bobbin bodies 104*a* to 104*e* are detachably inserted.

It is enough for the above bobbin station 102 to retain the plurality of bobbin bodies 104*a* to 104*e* detachably in a standby state, and there are no need any specific constructions therefor. In the embodiment shown in FIG. 1, however, a plurality of bobbin receiving portions 112 (four in the illustrated embodiment) are formed on two rail members 110, 110 opposing to each other, and the bobbin bodies 104*a* to 104*e* are detachably set in the bobbin receiving portions 112.

The bobbin station 102 (or the rail members 110,110 in the illustrated embodiment) may be movable so that the bobbin bodies 104*a* to 104*e* are easily passed between the rotary creel F and the bobbin receiving recesses 108. Also, it is preferable that the bobbin bodies 104*a* to 104*e* are automatically passed by a known robot hand or the like according to the preset pattern data (yarn order).

Figure 2:
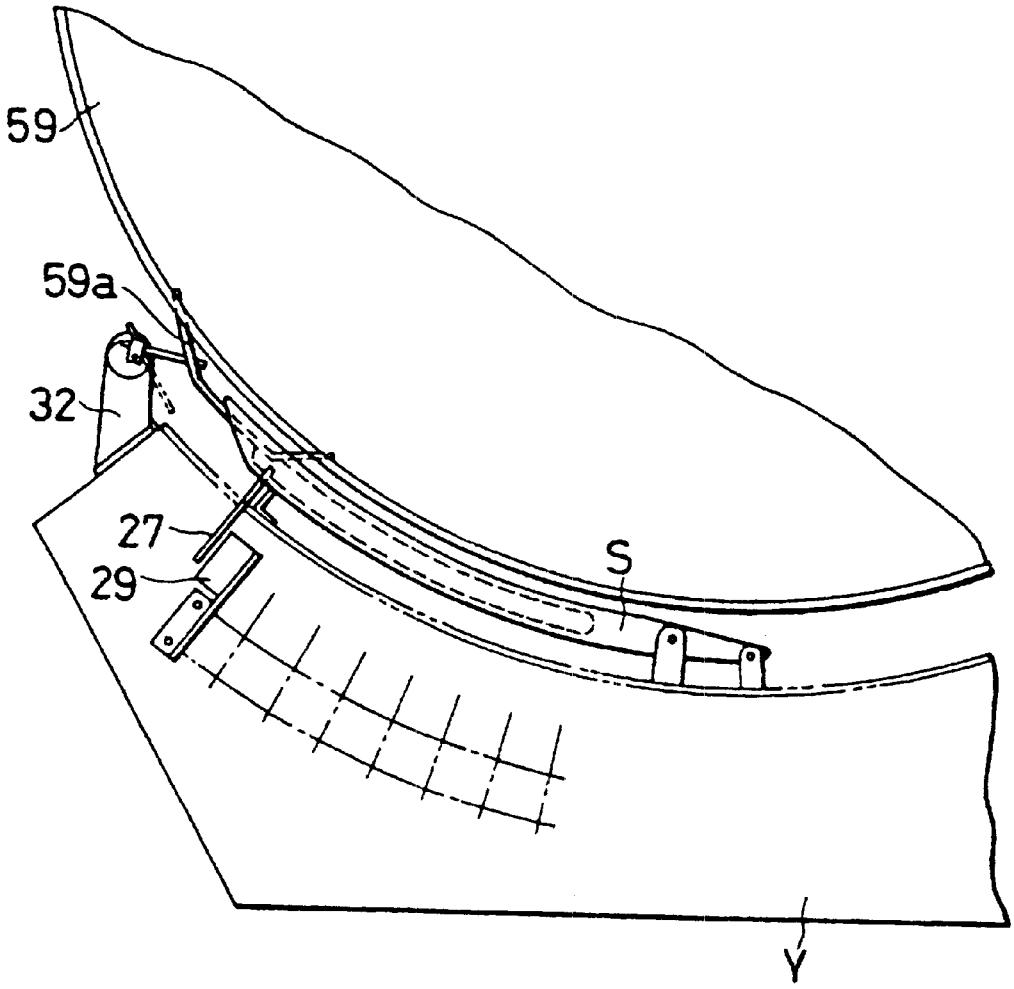
FIG. 2 is a partial explanatory view showing the manner in which a yarn selection guide is arranged.

As the above-mentioned yarn selection guides 27, such conventional ones as shown in FIG. 2 can be used. In FIG. 2, the plurality of yarn selection guides 27 selectively guide yarns 22*a* to 22*e* according to the instructions from a program setting unit. The yarn selection guides 27 are attached one to each rotary solenoid 29. When the individual rotary solenoid 29 is energized, the corresponding yarn selection guide 27 is pivotally moved to advance to its operative position (yarn exchanging position) as shown with a phantom line in FIG. 3; when the rotary solenoid 29 is de-energized, the yarn selection guide 27 is reversely pivotally moved to its standby position (yarn storing position) as shown with a solid line in FIG. 3.

Figure 3:
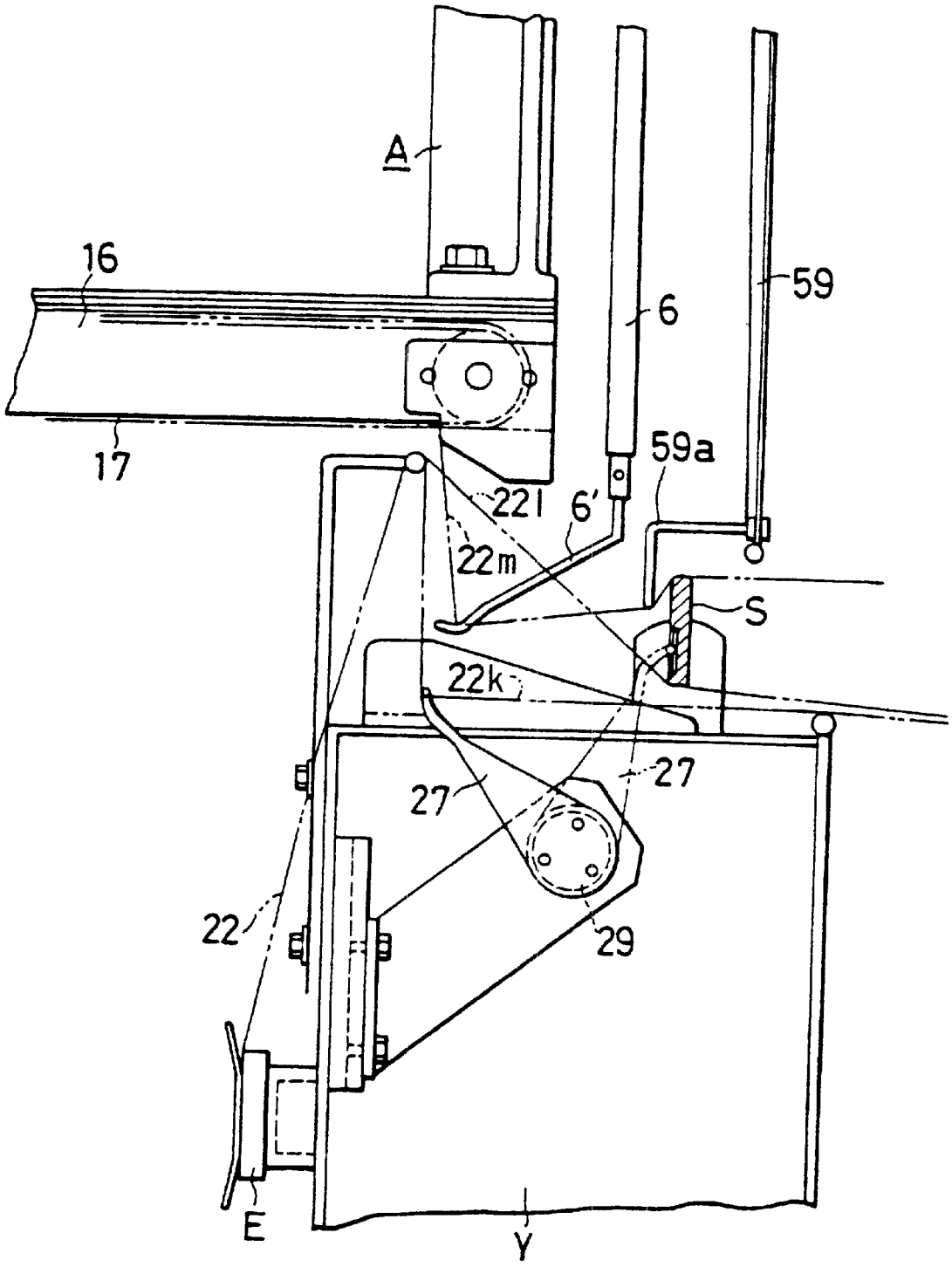
FIG. 3 is the first partial explanatory view showing a movement of a yarn selection guide.
Figure 4:
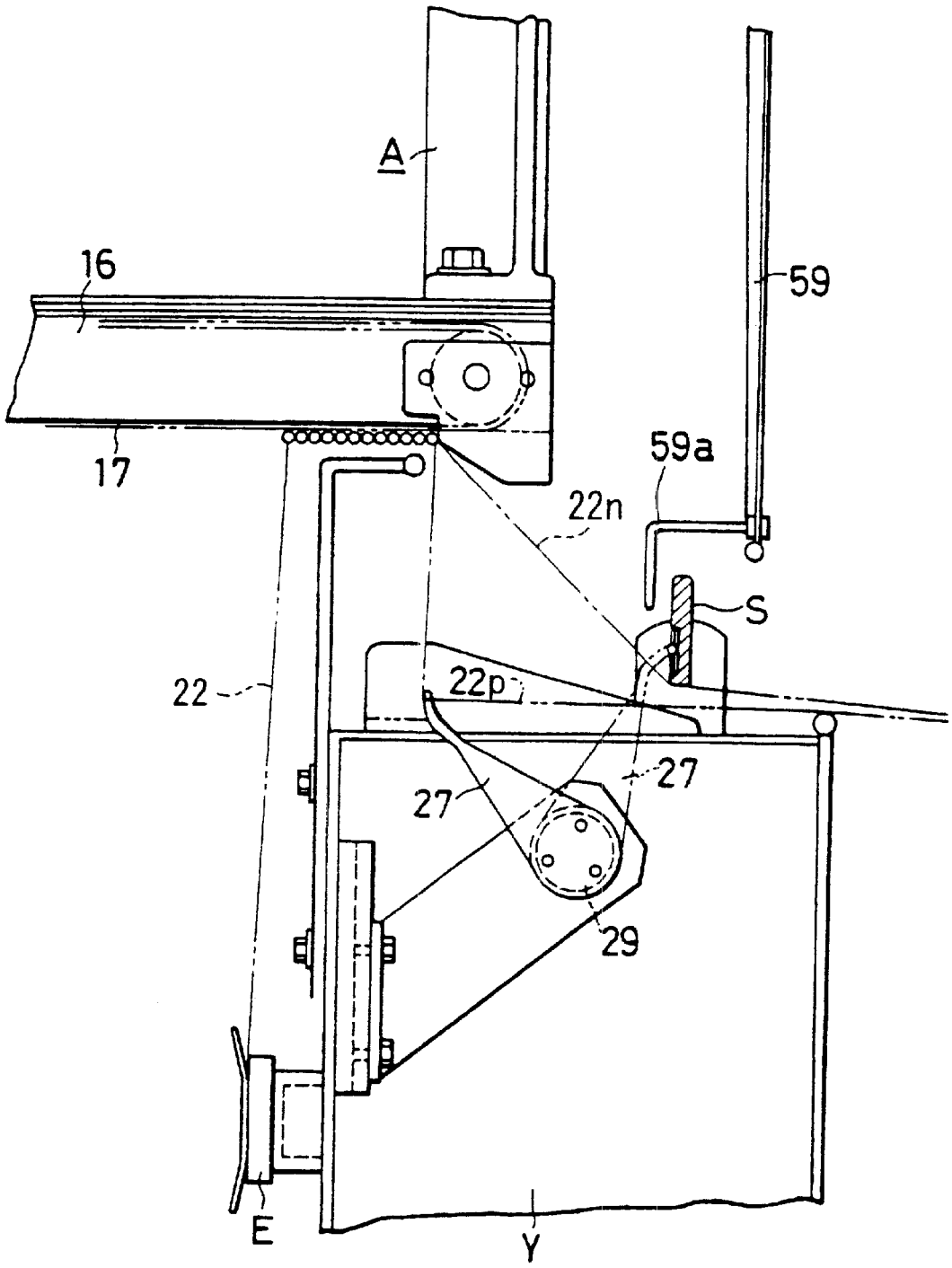
FIG. 4 is the second partial explanatory view showing another movement of a yarn selection guide.

The movements of the yarn 22 during the yarn exchanging are shown in FIGS. 3 and 4. The distal end of the yarn introduction means 6 is inwardly bent to provide a yarn introduction part 6' which is disposed against the front end of the outer periphery of the warper drum. The yarn 22*k* caught by the selection guide 27 initially located in its standby position (yarn storing position) assumes its yarn position 221 as the selection guide 27 is pivotally moved to advance to its operative position(yarn exchanging position) as shown with a phantom line. From this position, the yarn 221 is caught by the yarn introduction part 6' and wound around the warper drum A. The yarn selection guide 27 from which the yarn is removed is returned to the standby position (yarn storing position). 22*m* designates the posture in which the yarn 22 is moved one turn, and when the yarn is not exchanged the yarn is wound around the warper drum A passing through an upper side of a guide plate S as in this posture.

When the yarn 22*m* being caught by the yarn introduction part 6' and wound on the warper drum A is removed therefrom by a yarn removing unit 32, the yarn 22*m* is pulled back to the direction of the rotary creel by a pulling-back device (not shown) and guided to a lower side of the guide plate S by a guide bar 59*a*, then assuming its posture 22*n*. The yarn selection guide 27 is pivotally moved to advance to its operative position to catch the removed yarn, and returns to the standby position (yarn storing position) with holding the yarn. The yarn in the standby position assumes its posture 22*p* in FIG. 4.

In FIGS. 2 to 4, 16 designates a drum spoke of the warper drum A; 17, a conveyor belt provided on the drum spoke 16; 59, a yarn introduction cover arranged on one side of the warper drum A; 59*a*, a guide bar attached on the inner surface of a lower portion of the yarn introduction cover 59; and E, a yarn fastener mounted to a base Y.

The operation of the above-described electronically controlled sample warper W will now be described.

Firstly, as shown in FIG. 1, the bobbin bodies 104*a*, 104*b* are inserted into the bobbin receiving recesses 108, 108 of the rotary creel F, and yarns 22*a*, 22*b* are wound around the warper drum A by the yarn introduction means 6*a*, 6*b*. On the other hand, the bobbin bodies 104*c*, 104*d* are set in the bobbin receiving portions 112, 112 of the bobbin station 102 in a standby state, and yarns 22*c*, 22*d* are out of operation.

Next, when winding of four yarns 22*a* to 22*d* is performed, the bobbin bodies 104*c*, 104*d* are inserted into the remaining bobbin receiving portions 108, 108 of the rotary creel F, and the yarn selection guides 27 are operated so that the yarns 22*c*, 22*d* are moved to advance to the yarn exchanging positions from the yarn storing positions to be held by the yarn introduction means 6*c* and 6*d*,thereby the yarns being wound around the warper drum A.

When winding of the yarns 22*a*, 22*b* is out of operation, the bobbin bodies 104*a*, 104*b* are detached from the bobbin receiving recesses 108, 108, then the yarns 22*a*, 22*b* are removed from the yarn introduction means 6*a*, 6*b* and caught by the yarn selection guide 27 to be stored, and the bobbin bodies 104*a*, 104*b* are set to the bobbin receiving portions 112, 112 of the bobbin station 102.

Furthermore, when winding of a new yarn 22*e* is performed, the bobbin body 104*e* is mounted to an empty bobbin receiving recess 108 of the rotary creel F, and on the other hand the yarn selection guide 27 is actuated to get the yarn introduction means 6*a* to catch the yarn 22*e* so that the yarn 22*e* can be wound around the warper drum.

Thus, it is easy to use larger number of the bobbins 100*a* to 100*e* (five in the illustrated embodiment) than the number of the yarn introduction means 6*a* to 6*d* (four in the illustrated embodiment) so that a wide variety of pattern warping may be unlimitedly performed. Also, the reduction of the warping time may be realized by concurrently winding a plurality of yarns on the warper drum A.

In the above-mentioned embodiment, there is described the case wherein four yarn introduction means 6*a* to 6*d*, four bobbin receiving recesses 108 of the rotary creel F, four bobbin receiving portions 112 of the bobbin station 102, and five bobbins 100*a* to 100*e* are used. It is possible, however, to employ eight to sixteen or more of yarn introduction means 6, eight to sixteen or more of bobbin receiving recesses 108 of the rotary creel F, eight to twenty or more of the bobbin receiving portions 112 of the bobbin station 102, and eight to forty or more of the bobbins so as to perform ultimately a wide variety of pattern warping with various kinds of yarns.

In the above embodiment, there is explained the case wherein the yarn exchanging is performed by exchanging the bobbins of the rotary creel F for the ones of the bobbin station 102. In the case where there is no need to use the bobbins of the bobbin station 102, it is possible, as a matter of course, to warp only the yarns wound around the bobbins supported by the rotary creel F. In this case, the yarns wound around the bobbins supported by the rotary creel are guided to the yarn introduction means 6*a* to 6*d* through the yarn selection guides 27. Thus, such a manner as the yarn selection guide 27 are applied to the rotary creel F is a novel inventive idea which does not reside in any conventional electronically controlled sample warpers. The structure where the yarns are guided to the yarn introduction means 6*a* to 6*d* through the yarn selection guides 27 may advantageously and largely save time and labor in exchanging the bobbins and so on in comparison with the conventional one where the yarns of bobbins are directly guided to the yarn introduction means 6*a* to 6*d*. In this embodiment, using one yarn introduction means with the rotary creel F being in an inoperative state, there is no doubt that pattern warping may be performed as in the aforementioned known fixed creel.

As described above, according to the electronically controlled sample warper of the present invention, though using the rotary creel, it is possible to employ various kinds of yarns and perform the yarn exchanging thereof unlimitedly, thus enabling various pattern warping to be freely performed with the reduced warping time.

According to the rotary creel assembly of the present invention, it is possible to warp yarns on the warper drum with a plurality of bobbins supported by the rotary creel, set the remaining bobbins which are not used for warping yarns in the bobbin station in a standby state and perform the bobbin exchanging between the rotary creel F and the bobbin station 102. Therefore, the rotary creel assembly is used very preferably when performing pattern warping with a number of yarns.

Also, according to the warping method of the present invention, using the above-mentioned rotary creel assembly of the present invention, it is possible to perform pattern warping with various kinds of yarns and warp concurrently a plurality of yarns with the reduced warping time.

Obviously, various minor changes and modifications of the present invention are possible in the light of the above teaching. It is therefore to be understood that within the scope of appended claims the invention may be practiced otherwise than as specifically described.

What is claimed is:

1. An electronically controlled sample warper comprising:

a warper drum;

a plurality of yarn introduction means each mounted to a side surface of said warper drum for winding a yarn on said warper drum;

a plurality of yarn selection guides arranged in one end portion of a base for supporting said warper drum in correspondence to said yarn introduction means, each said yarn selection guide being pivotally moved to protrude to a yarn exchanging position when a yarn is exchanged and pivotally moved to retract to a standby position when a yarn is stored;

a rotary creel supporting a plurality of bobbins around which different kinds and/or the same kind of yarns are wound, said rotary creel being positioned adjacent corresponding ones of said plurality of yarn selection guides ;and a bobbin station supporting a plurality of bobbins around which different kinds and/or the same kind of yarns are wound in a standby state, wherein yarns are passed between said yarn introduction means and said yarn selection guides as well as said bobbins are passed between said rotary creel and said bobbin station such that said bobbin for a yarn held by said yarn introduction means and wound on said warper drum is supported on said rotary creel while said bobbin for a yarn stored in said yarn selection guide is supported by said bobbin station in a standby state, so that said yarns are exchanged according to the preset yarn order to be wound on said warper drum.

2. An electronically controlled sample warper of the present invention comprising:

a warper drum;

a plurality of yarn introduction means each mounted to a side surface of said warper drum for winding a yarn on said warper drum;

a plurality of yarn selection guides arranged in one end portion of a base for supporting said warper drum in correspondence to said yarn introduction means, each said yarn selection guide being pivotally moved to protrude to a yarn exchanging position when a yarn is exchanged and pivotally moved to retract to a standby position when a yarn is stored; and a rotary creel detachably supporting a plurality of bobbins around which different kinds and/or the same kind of yarns are wound, said rotary creel being positioned adjacent corresponding ones of said plurality of yarn selection guides, wherein yarns are passed between said yarn introduction means and said yarn selection guides, so that said yarns are exchanged according to the preset yarn order to be wound on said warper drum.

3. A rotary creel assembly comprising:

a rotary creel supporting a plurality of bobbins around which different kinds and/or the same kind of yarns are wound, said rotary creel being positioned adjacent corresponding ones of said plurality of yarn selection guides; and a bobbin station supporting a plurality of bobbins around which different kinds and/or the same kind of yarns are wound in a standby state.

4. A warping method using an electronically controlled sample warper having: a warper drum; a plurality of yarn introduction means each mounted to a side surface of said warper drum for winding a yarn on said warper drum; a rotary creel supporting a plurality of bobbins around which different kinds and/or the same kind of yarns are wound, said rotary creel being positioned adjacent corresponding ones of said plurality of yarn selection guides; and a bobbin station supporting a plurality of bobbins on which different kinds and/or the same kind of yarns are wound in a standby state, wherein said bobbins are passed between said rotary creel and said bobbin station such that said bobbin for a yarn held by the yarn introduction means and wound on said warper drum is supported on said rotary creel while said bobbin for a yarn stored in said yarn selection guide is supported by said bobbin station in a standby state, so that said yarns are exchanged according to the preset yarn order to be wound on said warper drum.

* * * * *